United States Patent [19]

Nitsche et al.

[11] Patent Number: 4,836,755

[45] Date of Patent: Jun. 6, 1989

[54] COMPRESSOR WITH BALANCED FLYWHEEL

[75] Inventors: Klaus D. Nitsche, Kirchheim; Johann P. Zsiga, Bietigheim-Bissingen, both of Fed. Rep. of Germany

[73] Assignee: Durr Dental GmbH & Co KG, Bietigheim-Bissingen, Fed. Rep. of Germany

[21] Appl. No.: 171,766

[22] Filed: Mar. 22, 1988

[51] Int. Cl.[4] ..... F04B 39/06; F04B 17/00; H02K 5/24; H02K 9/06

[52] U.S. Cl. ..... 417/368; 417/415; 417/419; 310/59; 310/51; 310/42; 310/63; 310/74; 29/156.8 CF; 416/144; 416/60; 416/500

[58] Field of Search ..... 74/573; 417/366, 368, 417/243, 415, 372; 416/60, 500, 144, 213 R; 310/59, 63, 74, 42, 51

[56] References Cited

U.S. PATENT DOCUMENTS

| | | | |
|---|---|---|---|
| 1,450,936 | 4/1923 | Barton | 416/60 |
| 1,470,607 | 10/1923 | Hazell | 415/213 R |
| 1,639,247 | 8/1927 | Zoelly | 416/190 |
| 1,754,922 | 4/1930 | Fabrin | 415/213 R |
| 2,336,697 | 12/1943 | Moeller | 74/573 |
| 2,558,737 | 7/1951 | Darnell | 74/573 |
| 2,655,868 | 10/1953 | Lindau | 415/213 R |
| 3,323,597 | 6/1967 | Longobardi | 416/500 |
| 4,190,402 | 2/1980 | Meece | 417/415 |
| 4,492,533 | 1/1985 | Tsuge | 417/372 |

FOREIGN PATENT DOCUMENTS

| | | | |
|---|---|---|---|
| WO83/03640 | 10/1983 | PCT Int'l Appl. | 417/368 |

*Primary Examiner*—Carlton R. Croyle
*Assistant Examiner*—Robert N. Blackmon
*Attorney, Agent, or Firm*—Fred Philpitt

[57] ABSTRACT

In a low capacity compressor, the shaft (20) of the drive motor carries a fan wheel (42) including a crank pin (46) formed integral therewith. The lower end of a connecting rod (62) is journalled on the crank pin (46). The portion of the fan wheel (42) opposing the crank pin (46) is formed with an arc shaped balancing rib (82) having an angular extension of 180°. Precise balancing of the piston/fan wheel unit is obtained by cutting material from the initially oversized balancing rib (82) and/or cutting from the portion of the fan wheel (42) being opposed to the balancing rib (82) so that a balancing groove (102) is obtained.

8 Claims, 5 Drawing Sheets

COMPRESSOR WITH BALANCED FLYWHEEL

DESCRIPTION

Figure 1:
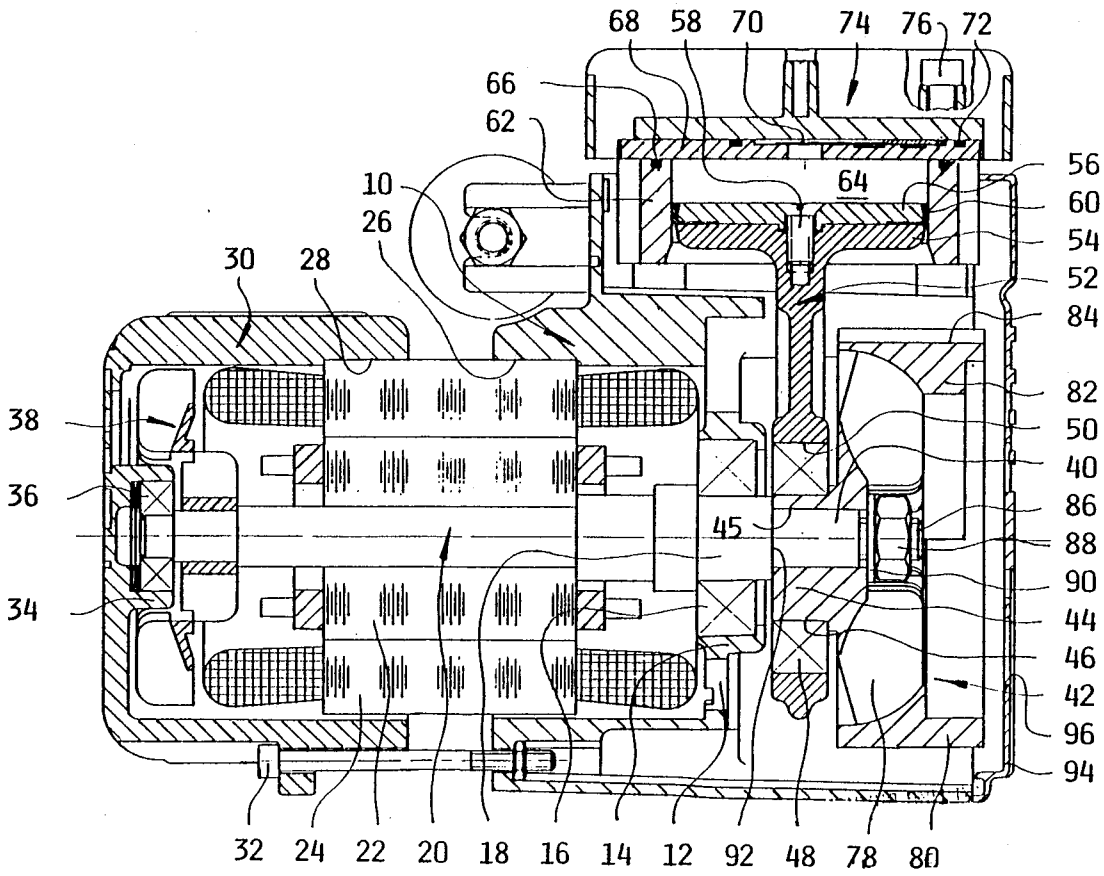

The invention relates to a compressor comprising a cylinder, a piston arranged in said cylinder for reciprocating movement, a drive motor acting on a cam shaft, a connecting rod for pivotally connecting a crank pin of the crank shaft to the piston and a balancing counter weight member.

In such known compressors, which are designed for high capacity, the balancing counter weight is formed by a portion of the crank shaft and balancing of the crank shaft is obtained in similar manner as in the crank shafts of internal combustion engines. In the production of small compressors emphasis is put on low production costs and balancing of the compressor is often renounced to.

It is an object of the present invention to provide a compressor which in addition to compact dimensions and low costs of production is essentially balanced.

To this end the invention proposes a compressor wherein the crank pin is formed integral with the fan wheel and the fan wheel simultaneously carries the balancing counter weight member and is arranged on the shaft of the drive motor.

In a compressor in accordance with the present invention the motor shaft can be given complete rotational symmetry. So this motor shaft can be a standard shaft of an electric drive motor. Since the crank pin and the counter weight member both form part of the fan wheel, this unit can be completely balanced before it is mounted on the standard motor shaft. This balancing can be achieved in a simple and low cost way of removing material from an oversized blank using numerically controlled machine tools. A further advantage of such a balance unit is that it is of small axial dimension.

Combining the crank pin, the fan wheel and the counter weight member in a single workpiece is also advantageous in view of simple assembly of the compressor: when the fan wheel is not yet arranged on the motor shaft, the crank pin is freely accessable from one side. Thus a bearing journalling the connecting rod of the piston can be easily slipped onto the crank pin so that no split bearings are required. The unit thus preassembled can in turn be easily arranged on the motor shaft.

Further improvements of the invention are defined in subclaims.

If the vanes of the fan wheel are arranged in planes containing the axis of the fan wheel, the fan wheel can be operated in either sense of rotation. It is not necessary, that the drive motor starts in a predetermined direction. Furthermore a tandem copressor can be realized using one and the same fan wheel. In such case the second end of the motor shaft carries a second fan/-crank pin unit driving the second piston of the compressor.

If the counterweight member is arranged such that it diametrically opposes the crank pin with respect to the fan wheel axis, the counter weight member can be given particularly simple geometry, i.e. it may have the form of a circumferentially extending rib of constant cross-section.

In view of producing various types of compressors of different stroke one can adopt a common universal moulded blank being formed with an oversized crank pin portion. By removing material from this oversized crank pin portion using a lathe fan wheels with crank pins of different excentricity can be obtained. Preferably the diameter of the crank pin is the same for the various types of fan wheels so that using the same connecting rods and the same pistons compressors of different stroke can be produced, the only difference residing in the different way of removing of material from the fan wheel blank.

It is particularly simple and easy to remove material from an initially oversized counter weight member of a fan wheel blank from the free end face of the fan wheel. Balancing can be obtained by varying the radial or axial extend of removal of material.

If the circumferential surface of the fan wheel is provided with a positioning groove, this will facilitate mounting of the fan wheel blank in a machine tool, which is used to form a crank pin being diametrically opposed to the counter weight member with respect to the wheel axis.

If a counter weight member is provided in the vicinity of the fan wheel, particularly if such counter weight member radially projects beyond the rim of the fan wheel, comparatively large unbalanced masses an be conpensated for with small amounts of additional material.

If the thickness or circumferential extension of the vanes of the fan wheel is increased in the portion of the fan wheel being opposed to the crank pin, a large counterweight can be provided within a given rim contour of the fan wheel.

In view of compensating major unbalanced masses and particularly in view of doing so for correcting variations in the production of the blanks or for making special types of a compressor in very small numbers, only, the portion of the fan wheel being adjacent to the crank pin may be formed with a circumferentially extending balancing groove.

Figure 2:
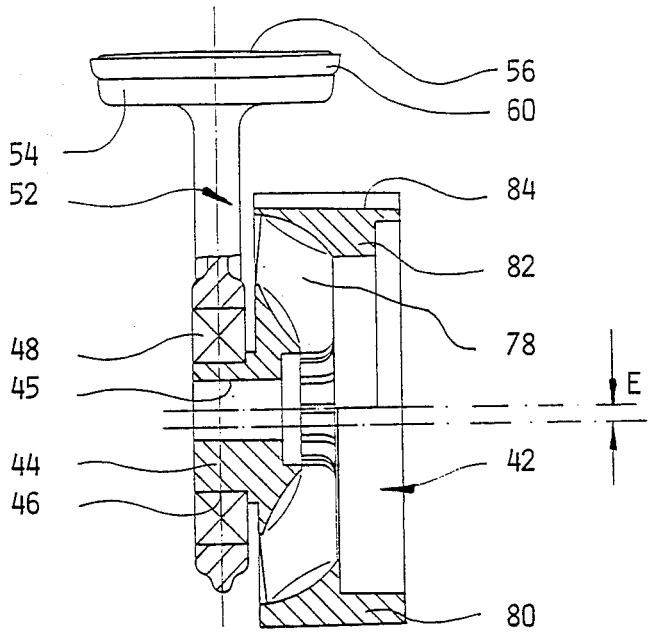
Figure 3:
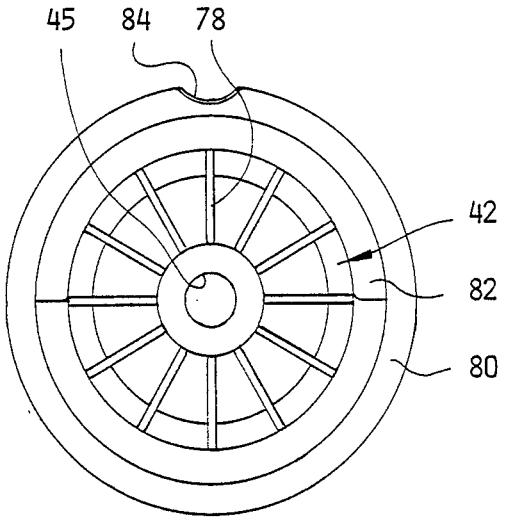
Figure 4:
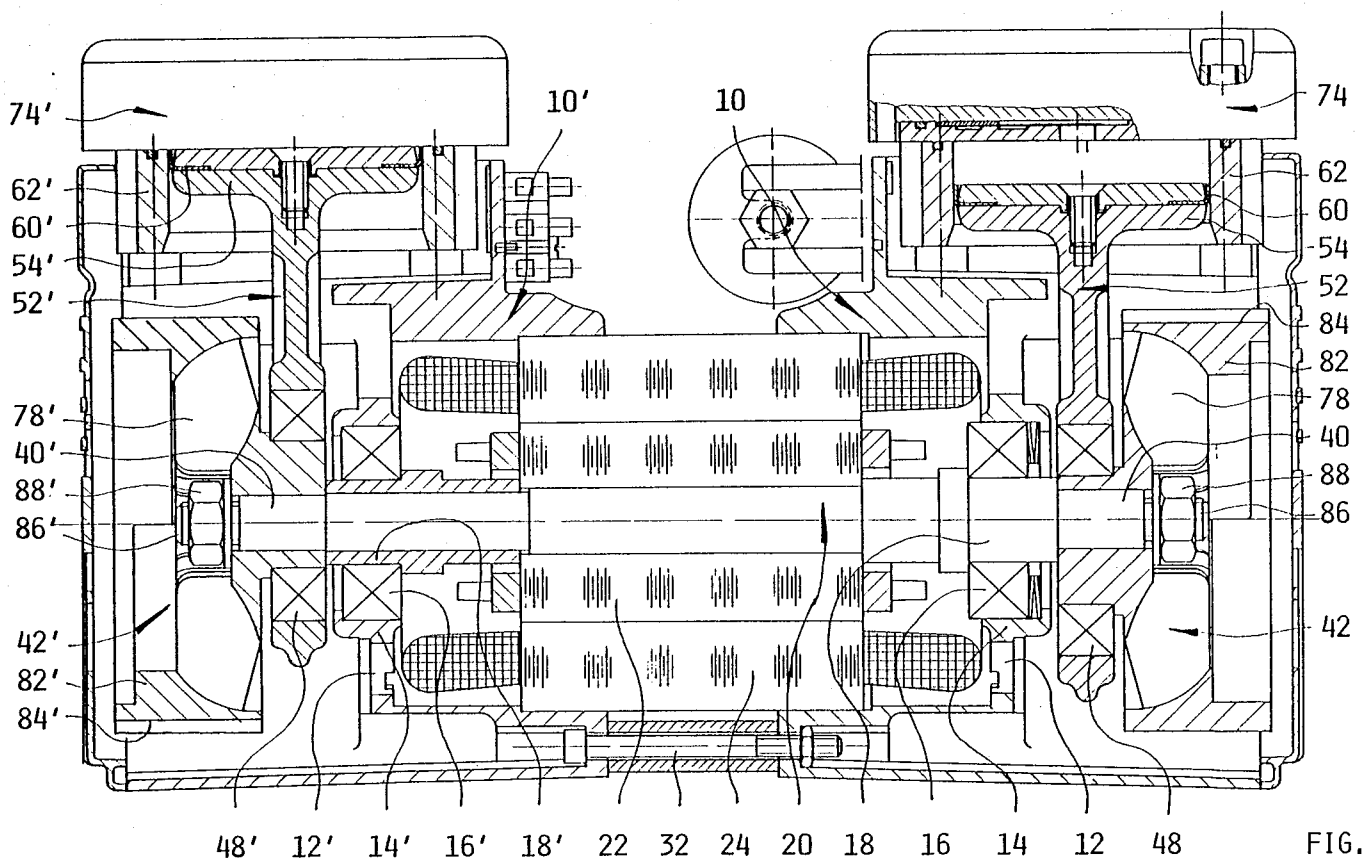
Figure 5:
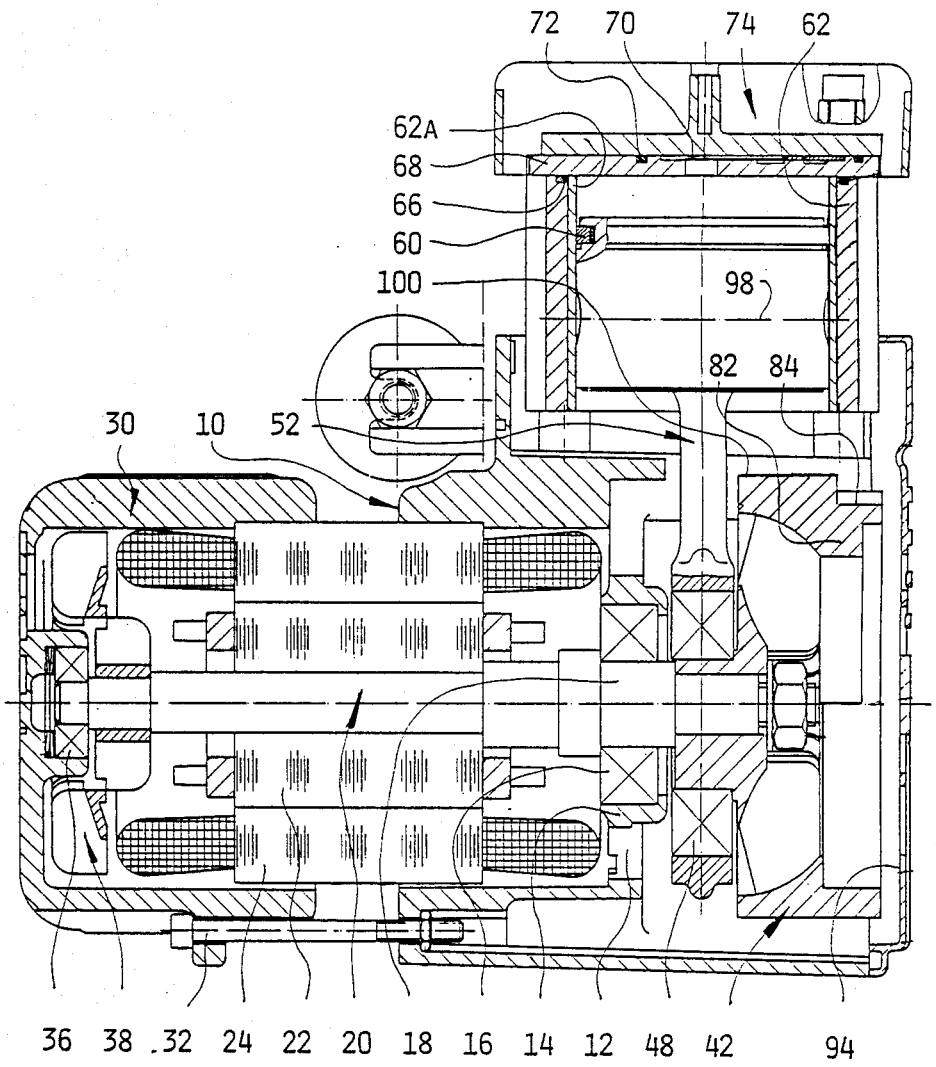
Figure 6:
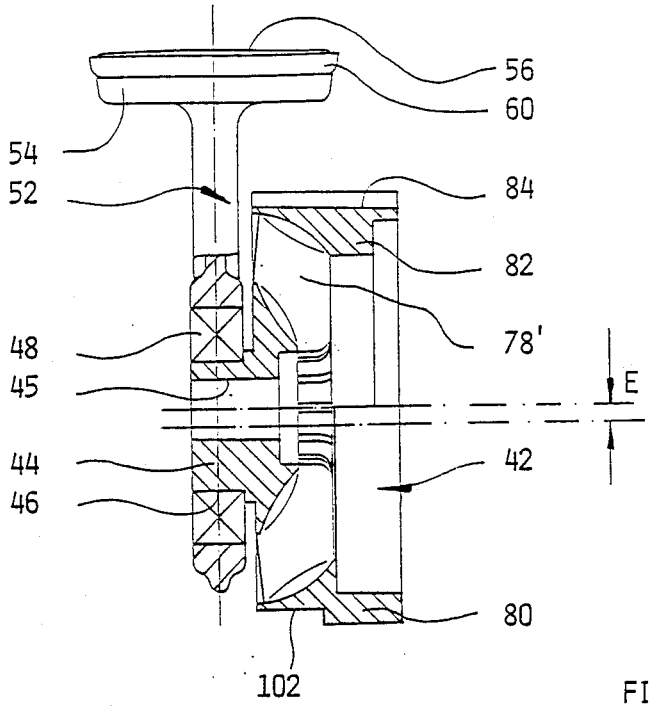
Figure 7:
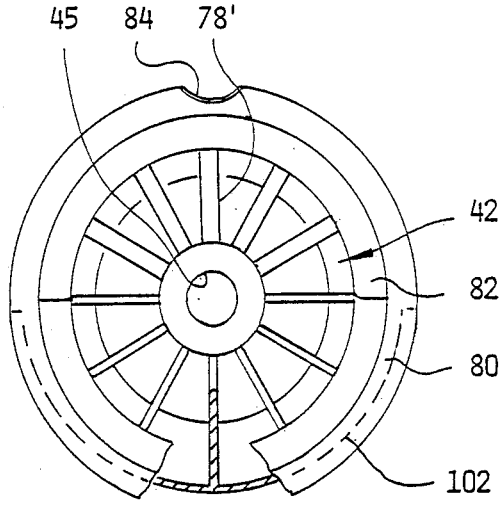

The invention will now be explained in more detail referring to the drawing. Therein FIG. 1: is an axial section of an oilfree compressor of low feed capacity;

FIG. 2: is an axial section through the piston/fan wheel unit of the compressor of FIG. 1;

FIG. 3: is an axial view of the free end face of the fan wheels shown in FIGS. 1 and 2;

FIG. 4: is an axial section of a tandem compressor comprising two piston/fan wheel units in accordance with FIG. 2;

FIG. 5: is an axial section similar to FIG. 1 showing a modified compressor;

FIG. 6: is an axial section through a modified piston/-fan wheel unit similar to the section shown in FIG. 2; and FIG. 7: is an axial view of the free end face of the fan wheel shown in FIG. 6.

FIG. 1 shows an axial section through an oilfree compressor of small feed capacity. The compressor shown will typically provide about 35 l/min at a pressure of about 7 bar.

A crank housing 10 comprises a plurality of radially invardly projecting webs 12 evenly distributed in circumferential direction. The webs 12 carry an annular seat portion 14 of the crank housing 10 receiving a roller bearing 16. The bearing race of the roller bearing 16 is fixed to a portion 18 of a motor shaft 20. The motor shaft 20 carries a rotor 22 cooperating with a stator 24.

The stator 24 engages in a motor receiving bore 26 of the crank housing 10 as well as in a motor receiving bore 28 of a housing end member 30. The stator 24 abuts against shoulders of the crank housing 10 and the housing end member 30. The housing end member 30 is connected to the crank housing 10 through threaded bolts 32.

A second seat portion 34 is formed integral with the housing end member 30 and receives a roller bearing 36 cooperating with the left hand end of the motor shaft 20. A fan wheel 38 is arranged on the left hand end of the motor shaft 20.

A cantilever right hand end portion 40 of the motor shaft 20 carries a fan wheel generally shown at 42. The fan wheel 42 has a crank pin and counter weight function integrated therein. To this end a hub portion 44 is arranged on the left hand end face of the fan wheel 42. The hub portion 42 is formed with a bore 45 receiving the motor shaft 20. The circumferential surface of the hub portion 44 has an axis parallel to the axis of the motor shaft 20 thus providing an eccentric surface 46. A roller bearing 48 is arranged on the excenter surface 46 and engages in an opening 50 formed in the lower end of a connecting rod 52. A lower disk shaped piston segment 54 is formed integral with the upper end of the connecting rod 52. An upper disk shaped piston segment 56 is connected to the lower piston segment 54 by means of a screw 58. A cup shaped piston ring 60 made from PTFE is sandwiched between the two piston segments 54, 56.

The piston segments 54, 56 are arranged in a cylinder 62 under large radial clearance. Sealing of a work space 64 of the compressor defined above the piston segment 56 is achieved through the piston ring 60.

The cylinder 62 is formed by a piece of material cut from an extruded endless profile of suitable cross-sectional geometry. This piece of material has undergone mechanical removal of material at its end faces, only. A seal ring 56 is inserted into the upper end face of the cylinder 62.

A valve plate 68 sealingly engages the upper end face of the cylinder 62. The valve plate 68 carries an outlet valve member 70 cooperating with control ports of the valve plate 68 to form a plate valve. The valve plate 68 furthermore carries an inlet plate valve member not shown in the drawings.

A further seal ring 52 is inserted into the upper surface of the valve plate 68. It cooperates with a cylinder head generally shown at 74. In the cylinder head 74 there are formed an inlet passage way and an outlet passage way which are not shown in the drawings.

The cylinder head 74 is forcefully connected to the crank housing 10 using threaded bolts 76. The valve plate 68 is forcefully sandwiched between these parts.

The fan wheel 42 is formed with vanes 78 extending in planes cutting the axis of the fan wheel. The vanes 78 extend to an annular rim portion 80 of the fan wheel. The rim portion 80 is formed with a radially inwardly projecting arc shaped balancing rib extending over 180 degrees. The balancing rib 82 is diametrically opposed to the eccentric surface 46 with respect to the axis of the motor shaft 20. A positioning groove 84 is provided in the outer circumferential surface of the annular rim portion 80 of the fan wheel 42. More particularly, the positioning groove 84 is arranged adjacent to the center of the balancing rib 82.

In view of connecting the fan wheel 42 to the motor shaft 20, the latter comprises a threaded end portion 86 receiving a nut 88. The nut 88 engages the hub portion 44 of the fan wheel 42 via a washer 90. Thus the fan wheel 42 is urged against a shoulder 92 of the motor shaft 20, which shoulder is defined by the shaft portions 18 and 40.

The right hand end of the crank housing 10 is closed by a cover member 94 being formed with ventilating slits 96.

For making the fan wheel 42 a fan wheel blank is produced having a hub portion 44 of large radial dimension. This will allow forming eccentric surfaces 46 of same diameter but different eccentricity simply by cutting material from the hub portion of the blank in different manner. Thus using the same fan wheel blanks, the same roller bearings 48 and the same connecting rods 52 compressors of different working stroke can be produced. In view of obtaining a balanced unit in spite of different eccentricity of the eccentric surface 46, the balancing rib 82 of the fan wheel blank is also oversized to an extent that it will be sufficient for balancing the eccentric surfaces 46 of greatest eccentricity. By cutting material from the interior circumferential surface of the balancing rib 82 and/or cutting material from the axial end face of the balancing rib 82 the mass of this rib can be reduced as is required in view of the actual eccentricity of the eccentric surface 46.

In order to warrant that the balancing rib 82, the circumferential extension of which remains unaltered in view of completely carring out the step of balancing on a numerically controlled lathe, will always exactly diametrically oppose the eccentric surface 46 with respect to the axis of the fan wheel 42, the positioning groove 84 is provided. This groove will positively position the fan wheel blank in predetermined angular orientation in a workpiece mounting device of the lathe.

Referring to FIG. 4 there will now be described a tandem compressor which is based on one and the same piston/fan wheel unit. The left hand side of the stator 24 engages in a second crank housing 10' being identical to the crank house 10 but being rotated by 180 degrees with respect to a vertical axis. The further components of the left hand side of the tandem compressor shown in FIG. 4 also correspond to parts of the tandem compressor shown in the right hand side of FIG. 4, which have already been discussed above referring to FIGS. 1–3. So these parts need not be explained in detailed below. These parts are designated by corresponding reference numerals to which an apostrophe has been added.

FIG. 5 shows an axial section through a compressor being quite similar to the one shown in FIG. 1. However, in the compressor in accordance with FIG. 5 the piston is not rigidly connected to the connecting rod. The piston is of the ordinary type and runs in the cylinder 62 under small radial clearance. The piston is pivotally connected to the upper end of the connecting rod 52, the pivot axis carrying the reference numeral 98.

From FIG. 5 also shows that a cylinder 62 of greater axial dimension can be simply obtained by cutting a correspondingly longer piece of material from the extruded profile already referred to above. An insert cylinder 62A is arranged within the cylinder 62.

In order to balance even greater unbalanced masses, the fan wheel 42 in addition to the balancing rib 82 being situated within the radial outer contour of the rim portion 80 a further balancing rib 100 radially projecting beyond the rim portion 80 is provided. The additional balancing rib 100 will preferably not undergo machining and the entire balancing of unbalanced masses is obtained by cutting material from the balancing rib 82 as has been explained above. Thus balancing of the fan wheel 42 can be completed without the need of rechucking the fan wheel.

In the embodiment shown in FIGS. 6 and 7 vanes 78' opposing the eccentric hub portion 44 are formed with increased thickness. This will also result in an additional counterweight or balancing mass which is added to the mass of the balancing rib 82.

In accordance with the embodiment shown in FIGS. 6 and 7 balancing of an unbalanced mass requiring increase of the counter unbalanced mass acting against the unbalanced mass of piston and eccentric crank pin is obtained by providing a circumferential balancing groove 102 opposing the vanes 78' of increased thickness. The balancing groove 102 is arranged at the axially inward end of the fan wheel 42 and has an angular extension of 180 degrees. By varying the axial and radial extension of the balancing groove 102 the size of the balancing mass can be varied. The effect of this negative unbalanced mass is the same as an increase in the mass of the opposing portion of the fan wheel which can be obtained by increasing the mass of the balancing rib 82 or forming the vanes 78' with increased thickness or by provision of the radially projecting balancing rib 100 shown inn FIG. 5.

Balancing the fan wheel 42 using the balancing groove 102 is particularly advantageous in that the unbalanced masses of second order (wobbling moments) are smaller.

Since provision of the balancing groove 102, which may be produced by cutting material from the fan wheel, makes it possible to increase the counter unbalanced mass beyond the counter unbalanced mass of the fan wheel blank, the balancing rib 82 and the vanes 78' of increased thickness shown in the upper portion of FIGS. 6 and 7 can be chosen such that the piston/fan wheel-unit is normally balanced without machining of the balancing rib 82. If the unbalanced mass to be compensated happens to be smaller than foreseen, one can simply remove material from the balancing rib 82. Contrarily, if the the unbalanced mass of the piston/fan wheel unit happens to exceed the predicted value, such condition can be compensated by removal of material from the lower portion of the fan wheel 42 resulting in the balancing groove 102.

From the above discussion it is clear that the fan wheel 42 has three functions:

It will feed cooling air to the inside of the crank housing 10, the major portion of which will flow along the outer surface of the cylinder 62 thus cooling it, while a small portion will flow through restricted passages defined by the outer surface of the stator 24 and the motor receiving bore 26 thus cooling the motor.

It includes a crank pin driving the piston, which is freely accessible from one end face thereof initially, so that a bearing can be slipped thereon. This type of crank pin can be used together with an unmodified standard motor shaft.

It includes a counterweight balancing the crank pin and the piston.

We claim:

1. A compressor comprising (a) a cylinder, (b) a piston arranged in said cylinder for reciprocating movement, (c) a drive motor including a motor shaft, (d) an eccentric crank pin mounted on said motor shaft, (e) a connecting rod for pivotally connecting said crank pin to said piston, (f) a balancing mass, which is diametrically opposed to the crank pin with respect to the motor shaft and which is formed integral with said crank pin, and (g) a fan wheel carried by the motor shaft for rotation therewith, characterized in that (h) the crank pin is formed by an eccentric surface (46) of an integral hub portion (44) of the fan wheel (42);

(i) the fan wheel (42) is formed with an integral annular rim portion (80); and (j) the balancing mass is formed by an integral circumferential balancing rib (82) of the fan wheel (42) being close to the rim portion (80) thereof.

2. The compressor of claim 1 wherein the angular extension of the balancing rib (82; 100) is about 180°.

3. A method for balancing the moving components of the compressor set forth in claim 1 wherein the balancing mass (82; 100) is adjusted to the moving masses of the piston (54–60), the connected rod (52) and the crank pin (46) by cutting material therefrom.

4. The method as set forth in claim 3 wherein the cutting of material from the balancing mass (82; 100) is achieved from one end face and one of the circumferential surfaces of the fan wheel (42).

5. A method for producing a compressor as set forth in claim 1 wherein the crank pin (46) is obtained by cutting material from a crank pin blank defining a volume of material being sufficient to form crank pins (46) of same diameter but different eccentricity.

6. The method of claim 5 which includes providing notch means (84) on the fan wheel (42) to locate the center of the balancing rib.

7. The compressor of claim 1 wherein at least a portion of the balancing mass is formed by vanes (78) of the fan wheel (42) being of increased thickness.

8. The compressor of claim 1 wherein a balancing groove (102) is formed in the portion of the fan wheel (42) being situated on the same side of the fan wheel axis as the crank pin (46).

* * * * *